United States Patent [19]

Tanov et al.

[11] 3,948,058

[45] Apr. 6, 1976

[54] DEVICE FOR SOIL SAMPLING UNDER WATER

[76] Inventors: Evgeny Ivanovich Tanov, ulitsa Dzerzhinskogo, 34; Viktor Yakovlevich Ploschadny, prospekt Svobody, 5, kv. 11, both of Ashkhabad, U.S.S.R.

[22] Filed: Oct. 16, 1974

[21] Appl. No.: 515,356

[52] U.S. Cl. ..... 61/63; 173/91; 173/137; 175/6; 175/20; 175/100

[51] Int. Cl.[2] ..... E02D 1/04

[58] Field of Search ..... 61/63; 175/20, 6, 100; 173/137, 135, 91

[56] References Cited

UNITED STATES PATENTS

| | | | |
|---|---|---|---|
| 3,561,546 | 2/1971 | Craig | 175/5 |
| 3,705,633 | 12/1972 | Sudinishnikov et al. | 173/91 |
| 3,756,328 | 9/1973 | Sudinishnikov et al. | 173/91 |

*Primary Examiner*—Jacob Shapiro
*Attorney, Agent, or Firm*—Steinberg and Blake

[57] ABSTRACT

The device features its housing carrying the soil sampling socket and the striker arranged coaxially to said socket, and adapted to act thereupon and establish some chambers in said housing, which are alternatively communicated, through the inlet fitting and the piping connected thereto, with a source of compressed air for the striker to perform forward and return strokes. The piping portion immersed in water is essentially a rigid pipe joined with the inlet fitting by way of an axially spring-loaded sleeve whose one end is rigidly connected to said pipe. Arranged along said pipe is another pipe rigidly coupled thereto and serving for used-up gas to discharge from said chambers to the water surface.

Such a device is applicable for soil sampling at depths amounting to several scores of meters.

8 Claims, 5 Drawing Figures

DEVICE FOR SOIL SAMPLING UNDER WATER

BACKGROUND OF THE INVENTION

The present invention relates generally to tools and appliances used in geological-engineering prospecting and is particularly concerned with devices for soil sampling under water layer.

The invention can be most advantageously used for sampling subwater soil situated at a depth of the order of dozens of metres.

The soil sampler made according to the present invention is applicable in geological surveying within the shelf zone, i.e., a subwater projection of a continent.

Known in prior art are devices for soil sampling under water layer, comprising an air-operated percussion mechanism carrying a soil sampling socket arranged coaxially therewith.

The percussion mechanism comprises a housing which accommodates a cylinder with a piston travelling therein and serving as the striker of the mechanism. A passage is defined between the cylinder outer surface and the housing inner surface, said passage communicating with a pipe connection provided at the top of the housing and communicated with a piping made as a flexible hose. The other end of said hose is connected to a source of compressed air.

The striker is adapted to establish chambers in the housing, said chambers alternatively communicating with said passage for admission of compressed air thereto.

To alternatively communicate said chambers with the passage, provision is made in the cylinder for top and bottom ports the striker overruns during its reciprocation under the action of compressed air admitted to pass into said chambers.

To discharge used-up air from the cylinder chambers, the latter are communicated with the ambient atmosphere through another passage and a pipe connection joined therewith. Said pipe connection (in fact, an air outlet) is mounted at the top of the housing and made as a curved down pipe, wherein a check valve is provided. While performing the working stroke the striker acts upon the socket to sink it into soil (cf., e.g., USSR Inventor's Certificate No. 169461, Cl. E21b, 25/00).

The afore-discussed known devices are adapted for soil sampling under relatively inconsiderable water layer and cannot be used for soil sampling from the bottom of water basins as deep as over few scores of metres.

As the piping is made as a flexible hose, when it is submerged for a depth at which hydrostatic pressure exceeds the pressure of compressed air source, the hose is liable to contort and obstruct air admission into the passage of the housing and into the cylinder chambers to actuate the striker which renders the whole device unserviceable at reasonably great depths.

In order to prevent the hose from contortion and failure the pressure of the source of compressed air has to be increased which leads to higher operational costs of such devices.

SUMMARY OF THE INVENTION

It is a primary object of the present invention to provide a device for soil sampling under water layer, wherein the piping and its joint with the pipe connection would be of such a constructional arrangement that would enable it to be used for soil sampling at depths of several scores of metres.

According to this and other objects provision is made for a device for soil sampling under water layer whose housing that carries the soil sampling socket, accommodates also the striker acting upon the socket and adapted to establish chambers in the housing, said chambers being alternatively communicated through an inlet fitting and piping connected thereto, with a source of compressed gas for the striker to perform a forward and return strike, and through an outlet fitting, with the atmosphere for the used-up gas to discharge, according to the invention the portion of the piping immersed in water is in fact a rigid pipe which is joined to the inlet pipe fitting throuogh an axially spring-loaded sleeve whose one end is rigidly connected to said pipe, and also provision is made for another pipe arranged along the former one, rigidly coupled thereto and connected to an outlet pipe fitting serving to discharge used-up gas, with a possibility of axial movement with respect thereto, said latter pipe having a length large enough to discharge used-up gas to the surface of water.

The herein-proposed device for soil sampling under water layer can be used for soil sampling at depths amounting to 100 m and over. The device is simple in construction, relatively inexpensive and reliable in operation.

BRIEF DESCRIPTION OF DRAWINGS

Other object and advantages relating to the device for soil sampling under water layer shall hereinafter appear in the following detailed specific exemplary embodiment thereof having reference to the accompanying drawings forming a part of this specification.

In the drawings.

DESCRIPTION OF THE PREFERRED EMBODIMENT

Figure 1:
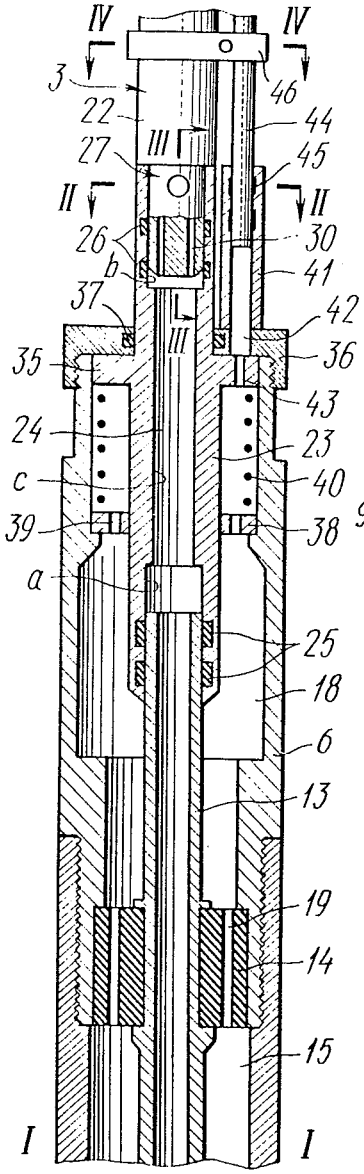
FIGS. 1 and 1' together provide a fragmentary axial-section view of a soil sampler, according to the invention, showing it components with the lower end of I—I of FIG. 1 to be considered as joined to the upper end of I'—I'.
Figure 1:
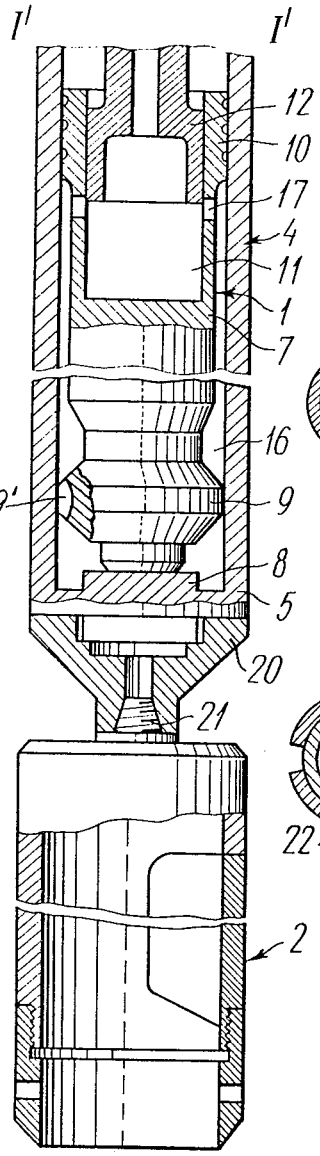

Now referring to the accompanying drawings, the soil sampler comprises an air-operated percussion mechanism 1 (FIG. 1) a soil sampling socket 2 coaxial thereto and rigidly coupled therewith, and a piping 3 serving to feed compressed gas to the air-operated percussion mechanism from an external source (not shown) of such gas. In the herein-disclosed particular embodiment of the invention use is made of compressed air as a power gas.

In the herein-considered embodiment of the invention the air-operated percussion mechanism 1 has a housing 4 composed of two portions, viz., a bottom portion 5 and a top portion 6 interconnected by thread.

A cylindrical chamber is made in the housing 4, accommodating a striker 7 capable of reciprocating motion. The bottom (as seen in the drawing) portion 5 of the housing 4 accommodates an anvil 8 made integral with said portion of the housing 4.

The striker 7 is made as a cylinder whose outer side surface carries two collars 9 and 10 spaced somewhat apart, the outside surface of both collars being in constant contact with the inside surface of the housing 4.

A central cylindrical chamber 11 is provided in the striker 7 closer to its upper (as seen in the drawing) end face, said chamber partially accommodating a spool 12 made as a hollow stepped cylinder whose portion having a maximum diameter is fitted in the chamber 11 of the striker 7.

The top (as seen in the drawing) portion of the spool 12 having a minimum diameter, serves as an inlet pipe fitting 13 for compressed air to enter into the chamber 11. For joining the spool 12 to the inlet pipe fitting 13 a circular rubber damper or spring means 14 is provided in the housing 4, resting with its faces upon the flanges made respectively in the housing 4 and on the spool 13.

Thus, a chamber 15 is established, confined to the inside surface of the housing 4, the outside surface of the pipe fitting 13 and the face surfaces of the damper 14 and the striker 7, while another chamber 16 is formed between the inside surface of the housing 4 and the outer side surface of the striker 7.

The chambers 15 and 16 are separated from each other by the collar 10 provided on the outside surface of the striker 7.

To periodically communicate the chamber 16 with the chambers 15 and 11 during strokes of the striker 7, ports 17 are made in the lateral wall thereof, while for communicating the chamber 15 with a chamber 18 located above the damper 14, a number of longitudinal passages 19 are made in the latter.

An adapter 20 serves for attaching the socket 2 to the housing 4, having a threaded taper hole and being rigidly coupled to the housing 4. The socket 2 has a taper tailpiece 21 located at the centre of the top thereof and made integral therewith. The tailpiece is connected to the adapter 20 through a threaded joint.

The portion of the piping 3 that is immersed in water, is essentially a rigid pipe 22 constituted by a number of separate pipe sections (not shown).

The end of said pipe is connected to the pipe fitting 13 by way of a sleeve 23. The length of the pipe 22 corresponds to or somewhat exceeds the depth of immersion of the sampler.

The sleeve 23 is cylinder-shaped and has a bore 24 for compressed air to pass.

At its opposite ends the sleeve 23 has sections *a* and *b*, wherein the diameter of the bore 24 is somewhat larger than that of the bore 24 at a middle section *c*. The sections *a* and *b* of the sleeve 23 has annular grooves for respective seals 25 and 26.

With its bottom section *a* the sleeve 23 is fitted over the pipe fitting 13 so as to freely move thereabout.

Figure 2:
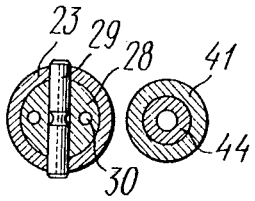
FIG. 2 is an enlarged view of a section taken along the line II—II in FIG. 1.

With its top section *b* the sleeve 23 is rigidly coupled to the pipe 22 which is attained owing to a lock 27 located inside the top section *b* of the sleeve 23. The lock 27 comprises a cylindrical component 28 (FIGS. 1, 2, 3) and a pin 29.

Figure 3:
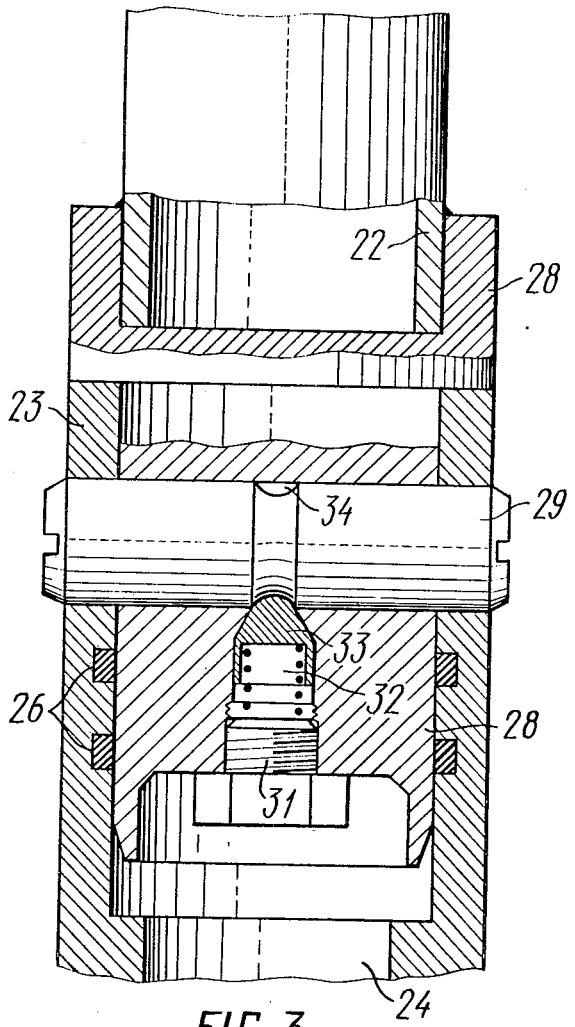
FIG. 3 is an enlarged view of a section taken along the line III—III in FIG. 1.

The lock component 29 is rigidly coupled to the pipe 22 by virtue of a welded joint as seen in FIG. 3 and has axial passages 30 (FIGS. 1, 2) for compressed gas to pass.

The lock 27 is connected to the sleeve 23 by the pin 29 for which purpose coaxial holes are provided in the sleeve 23 and the component 28. The pin 29 is kept against axial displacement by a bolt 31 (FIG. 3) through a spring 32 and a member 33 adapted to engage a recess 34 made in the pin 29.

Such a joint of the sleeve 23 and the pipe 22 enables quick disassembly and reassembly of both.

Similar locks may be used for joining the sections the pipe 22 is composed of.

The outside surface of the sleeve 23 carries an annular flange 35 which with its lateral surface is in constant contact with the housing 4.

The housing 4 is closed at top (as seen in the drawing) with a cap 36 which in fact a nut with a central hole for the sleeve 23 to pass. The cap 36 houses a seal 37. A ring 38 is provided in the portion 6 of the housing 4, spaced somewhat apart from the annular flange 35 and having holes 39 for compressed gas to pass. The ring 38 rests upon a shoulder provided in the portion 6 of the housing 4. A spring 40 is fitted in between the annular flange 35 and the ring 38, the load upon said spring being regulated by virtue of drawing the cap 36 more or less tight.

Such a joint of the pipe 22 and the pipe fitting 13 enables the weight load exerted by the pipe 22 to be imposed upon the housing 4 which, in turn, makes it possible to relieve the percussion mechanism 1 and, consequently, ensure a proper and sure starting of the sampler and its reliable operation.

An outlet pipe fitting 41 is provided on the cap 36, adapted for used-up gas to discharge from the chamber 18. To communicate the pipe fitting 41 with the chamber 18, respective passages 42 and 43 are made in the cap 36 and the annular flange 35 for used-up gas to pass.

A number of passages may be made in the annular flange 35 of the sleeve 23 which will make it possible to communicate the chamber 18 with the passage 42 more conveniently and simply when adjusting the amount of load imposed upon the spring 40.

A pipe 44 is fitted in the outlet fitting 41 with a possibility of axial displacement, adapted for discharging used-up gas to the surface of water.

The outlet pipe fitting 41 is provided with seals to impart air-tightness of the joint between the pipe 44 and the pipe fitting 41.

Figure 4:
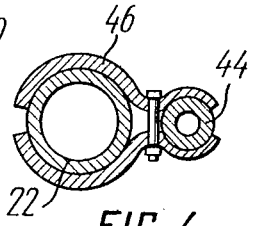
FIG. 4 is an enlarged view of a section taken along the IV—IV in FIG. 1.

The pipe 44 is arranged along the pipe 22 and is substantially equal in length thereto. Said pipes 22 and 44 are rigidly interconnected by pipe clamps 46 (FIGS. 1, 4) spaced apart throughout the length of the pipes 22 and 44 at a distance short enough to ensure rigid interconnection thereof.

The pipe 44 is made rigid in the herein-disclosed particular embodiment of the invention; alternatively, said pipe may be made of any elastic material.

Provision of the pipe 22 in a rigid construction and its rigid connection to the pipe 44 for discharge of used-up gas enables the sampler to vertically descend to the bottom of a water basin.

The device for soil sampling under water layer operates as follows.

When in the initial position the device is immersed in water; the striker 7 rests upon the anvil 8 and its ports 17 intercommunicate the chambers 11 and 16.

Compressed air from a source (not shown) is fed along the piping 3, the sleeve 23 and inlet pipe fitting 13 into the chamber 11, wherefrom compressed air passes through the ports 17 in the side wall of the striker 7 to fill the chamber 16 established between the inside lateral surface of the housing 4 and the outside lateral surface of the striker 7 so as to pass into the bottom portion thereof through passages 9′ provided in the collar 9.

Owing to a difference between the pressures exerted by compressed air upon the bottom (as seen in the drawing) end face of the striker 7 and upon the bottom-plate of the chamber 16, having these different areas, the striker 7 starts performing its upstroke (as seen in the drawing). During the striker upstroke the side surface of the spool 12 closes the ports 17, the result being that compressed air ceases to pass into the chamber 16.

Further upward motion of the striker 7 is by virtue of compressed-air expansion occurring in the bottom portion of the chamber 16. The striker 7 keeps moving upwards until its ports 17 get above the portion of the spool 12 of maximum diameter. After that compressed air from the chamber 16 starts passing into the chamber 15 and further on, through the passages 19 in the damper 14, into the chamber 18. Next, used-up air passes through the holes 39 in the ring 38 and along the respective passages 43 and 42 in the annular ridge 35 and the cap 36, into the outlet pipe fitting 41 and then is discharged through the pipe 44 to the surface water (into atmosphere), i.e., an exhaust of used-up air occurs. At that instance air pressure effective in the chamber 11 is much higher than that effective in the chamber 18 (equal to atmospheric pressure), therefore the descent of the striker 7 occurs by virtue of a difference between said pressures and also under its own weight, and terminates in the striker impact against the anvil 8 of the housing 4. As a result the socket 2 rigidly coupled to the housing 4, is sunk into soil.

At the moment of impact of the striker 7 against the anvil 8 the ports 17 establish communication between the chambers 11 and 16, with the result that the latter chamber is filled with compressed air and the striker 7 starts again ascending. Thus, the entire working cycle of the percussion mechanism 1 will be repeated. The operating cycle of the percussion mechanism is repeated until the soil sample core fills the socket 2 to capacity. Reaction force developed by the percussion mechanism 1 is taken up by the spring 40 through the sleeve 23 and relayed to the housing 4.

The spring-loaded sleeve 23 allows also of avoiding the effect of the weight of the pipe 22 upon the percussion mechanism which is due to the fact that the sleeve 23 is free to slide on the pipe fitting 13. The amount of displacement of the sleeve 23 about the pipe fitting 13 is defined by the rate of the spring 40.

The pipe 44 moves in the pipe fitting 41 for a length equal to the rate of the spring 40 in virtue of being rigidly coupled to the pipe 22.

Once the socket is filled with soil to capacity, compressed air is no longer fed to the sampler and the latter is withdrawn from water by means of a load-lifing gear (not shown), for the socket to be taken out and the soil sample core extracted therefrom. Whenever necessary, the socket may be provided with a device for retention of soil sample core when raising the sampler to the surface of water.

It will thus be seen that the structure of the invention includes an elongated housing means 4 made up of the components 5 and 6 which are threaded together, this housing means 4 having a bottom anvil wall 8 to which the socket means 2, for receiving the soil sample, is connected by way of the components 20 and 21, with the housing means 4 accommodating in its interior for slidable movement therealong the striker means 7 which is adapted repeatedly to strike against the anvil wall 8 in the manner described above. This striker means 7 slidably engages the inner surface of the elongated housing means 4 and is formed with an upper hollow interior portion 11 which slidably receives the lower end portion of an elongated tubular supply means which serves to supply fluid under pressure, namely compressed air in the above example to the hollow interior portion 11 of the striker means so as to drive the latter along its driving stroke into impact engagement with the anvil wall 8. The tubular means for supplying the fluid under pressure includes the elongated tubular component 13 which is completely housed within the housing means 4 and the elongated tubular assembly made up of the sleeve 23 and the piping structure 3 connected to the sleeve 23, this tubular supply means having at its portion 23 which extends into the housing means 4 a slidable fluid-tight connection with the upper portion of the tubular component 13 of the tubular supply means while the housing means 4 itself has a fluid-tight slidable engagement with the tubular supply means at its lower sleeve portion 23 which extends from the exterior to the interior of the housing means. It will be noted that the tubular component 13 of the tubular supply means is carried only by the spring means 14 which is mounted in the interior of the housing means 4 so as to determine the axial position of the tubular component 13 therein while this spring means 14 in addition serves to provide communication between the hollow interior spaces of the housing means 4 situated above and below the spring means 14. In this way the support of the component 13 only by the spring means 14 prevents the weight of the structure above the tubular component 13 from pressing downwardly on the latter and from interfering with the proper operation of the striker means. At the same time by way of the annular nut member 36 which provides the slidable fluid-tight connection between the housing means 4 and the tubular supply means and the flange 35 which is fixed to the sleeve 23 and which thus is rigid with the entire pipe assembly 3, it will be seen that the entire housing means is in effect hung or suspended by its top wall formed by element 36 by way of the engagement between the latter and the flange 35 so that in this way also the weight of the entire assembly is insulated from the housing means 4. Of course, the spring 40 serves to urge, by way of engagement with the apertured plate 38 which rests on a shoulder of the housing means 4, the top end 36 of the housing means 4 against the flange 35 which is fixed to the piping 3.

In addition to the above structure it will be seen that an important part of the structure of the invention is formed by the tubular discharge means 44 through which the fluid under pressure is capable of rising through the water to the atmosphere above the surface thereof, the striker means 7 serving in the manner described above, at the end of its upward stroke away from the anvil wall 8, to place the fluid under pressure beneath the striker means in communication with the upper interior space of the housing means 4 which communicates with the tubular discharge means 44. Since this tubular discharge means 44 includes the sleeve 41 which is fixed to the housing means and which has a fluid-tight slidable engagement with the lower part of the tube 44, this connection of the tubular discharge means to the interior of the housing means does not interfere with the capability of the housing means to be hung from the flange 35 while still being free to move axially along the tubular supply means by way of a fluid-tight connection provided in the interior of the sleeve 41 and by way of the seal 37 in the opening of the top wall of the housing means which surrounds the tubular supply means, and of course the same is true of the cooperation by way of the sealing rings 25 with the tubular component 13 inasmuch as this tubular component 13 will move with the housing means 4 through the resilient connection therewith provided by way of the spring means 14, with this movement being accommodated by way of the fluid-tight slidable connection between the lower end of the sleeve 23 and the top end of the tubular component 13.

What we claim is:

1. In a device for obtaining a sample of matter situated beneath a body of water, elongated housing means having a hollow interior limited at one end by a bottom anvil wall, said housing means having an opposed top end distant from said anvil wall, socket means fixedly carried by said housing means and extending downwardly beyond said bottom anvil wall thereof for receiving a sample of the matter beneath a body of water, striker means slidably situated within said housing means for repeatedly striking against said anvil wall for driving said socket means into the matter beneath the body of water so as to situate a sample of said matter in said socket means, said striker means having distant from said bottom anvil wall an upper hollow interior portion, tubular supply means for supplying to said striker means, in said upper interior hollow portion thereof, a fluid under pressure for driving said striker means against said anvil wall, said tubular supply means extending fluid-tightly through said top end of said housing means into the interior thereof and having a lower portion slidably received in said upper interior hollow portion of said striker means, the latter cooperating with said lower portion of said tubular supply means and with the inner surface of said housing means first to be driven downwardly by fluid under pressure into impact with said anvil wall, then to be raised in said housing means by said fluid under pressure away from said anvil wall through a given upward stroke, and at the end of said upward stroke placing the space beneath said striker means in communication with the space in said housing means above said striker means to again be released to the force of the fluid under pressure to be driven thereby downwardly into impact with said anvil wall, and tubular discharge means operatively connected with said housing means and communicating with the interior space thereof above said striker means and surrounding the part of said tubular supply means which extends into the interior of said housing means so that through said tubular discharge means fluid under pressure can be discharged out of the interior of said housing means, said tubular supply means and said tubular discharge means both having substantially rigid portions extending upwardly beyond said housing means through a distance sufficient to extend upwardly beyond the surface of the body of water so the pressure of the body of water will not interfere with the flow of fluid through either of said tubular means.

2. The combination of claim 1 and wherein at least said tubular supply means includes above said housing means a plurality of tubular sections and releasable lock means releasably locking said sections to each other without interrupting the flow of fluid through the successive sections of said tubular supply means.

3. The combination of claim 1 and wherein a means connects said tubular discharge means to said tubular supply means above said housing means so that both of said tubular means are connected to each other to form together a substantially rigid assembly extending upwardly from said housing means.

4. The combination of claim 1 and wherein said tubular supply means has at the region of the top end of said housing means a flange situated within the top end of said housing means and the latter engaging with its top end an upper surface of said flange so that the housing means is hung from said flange.

5. The combination of claim 1 and wherein said tubular supply means includes a sleeve extending fluid-tightly through said top end of said housing means into the interior thereof and an elongated tubular component forming an extension of said sleeve and having a fluid-tight slidable engagement therewith, said tubular component having said lower portion of said tubular supply means which is received in the upper hollow interior of said striker means, and spring means carried by said housing means in the interior thereof and supporting said tubular component therein while providing for communication between hollow interior portions of said housing means situated above and below said spring means.

6. The combination of claim 5 and wherein said top end of said housing means fluid-tightly surrounds and is slidable with respect to said sleeve, the latter having fixed thereto a flange having an upper surface engaged by said top end of said housing means, and spring means cooperating with said housing means and sleeve for urging said top end of said housing means into engagement with said flange.

7. The combination of claim 6 and wherein said tubular discharge means includes a lower tubular element fixed to and extending upwardly from said top end of said housing means and communicating through said top end thereof and through said flange with the interior of said housing means, and said tubular discharge means having a lower portion cooperating slidably and fluid-tightly with said tubular element.

8. The combination of claim 6 and wherein said spring means which urges top end of said housing means into engagement with said flange is situated within said housing means in engagement with said flange, said housing means having beneath said flange an apertured ring surrounding said sleeve, said housing means having in its interior a shoulder to be engaged by said ring, said latter spring means extending between said flange and ring for urging the latter against said shoulder to act through said shoulder on said housing means to urge said top end thereof downwardly against said flange.

* * * * *